United States Patent [19]

Ting et al.

[11] Patent Number: 4,754,251

[45] Date of Patent: Jun. 28, 1988

[54] THERMOSTATIC ELECTRIC SWITCH AND THERMAL BIASING ASSEMBLY THEREFOR

[75] Inventors: Youn H. Ting; Ronald W. Brown, both of Lexington, Ky.

[73] Assignee: Texas Instruments Incorporated, Dallas, Tex.

[21] Appl. No.: 116,102

[22] Filed: Nov. 3, 1987

[51] Int. Cl.[4] ..... H01H 61/02; H01H 37/52

[52] U.S. Cl. ..... 337/107; 337/102; 29/622

[58] Field of Search ..... 337/107, 104, 103, 102; 29/622

[56] References Cited

U.S. PATENT DOCUMENTS 4,533,894 8/1985 Bishop et al. ..... 337/107

4,591,820 5/1986 Ruszczyk et al. ..... 337/107

*Primary Examiner*—H. Broome

*Attorney, Agent, or Firm*—John A. Haug; James P. McAndrews; Melvin Sharp

[57] ABSTRACT

A housing has a switch chamber in which an electric switch is placed and a recess in which is received a snap acting, thermally responsive disc which actuates and deactuates the switch upon snapping from one configuration to another. A thermal biasing assembly used to modify the operating temperature of the disc has a pair of cylindrical film type resistors electrically connected in parallel circuit relation and physically connected to a pair of rivets. Resistors of a rating chosen for a particular application are dropped into the recess with the leads of the resistors received in bores provided in the housing. A rivet is then inserted into each bore making good electrical connection with the leads without welding by deforming them a selected amount. The rivets are attached to suitable terminals and the disc is then placed over the thermal biasing assembly to provide a multiple temperature operating thermostat.

17 Claims, 3 Drawing Sheets

THERMOSTATIC ELECTRIC SWITCH AND THERMAL BIASING ASSEMBLY THEREFOR

BACKGROUND OF THE INVENTION

This invention relates generally to thermostatic electric switches and more particularly to means for providing multiple temperature operation.

Thermostatic switches are used for switching of circuits upon the occurrence of preselected temperature conditions. In some applications it is desirable to effect switching upon the occurrence of more than one temperature. While this can be done by providing separate thermostatic switches for each temperature, assuming that there are no space limitations, this involves added expenses due to duplication of parts.

One approach to this problem is shown in U.S. Pat. No. 3,500,277 wherein a thermostatic switch is provided with two bimetal discs each adapted to snap from one dished configuration to an opposite dished configuration at different temperatures controlling separate circuits. A separate motion transfer pin operatively connects each disc to a respective switch. However there are applications where it is desirable to effect actuation of the same circuit at several temperatures which may vary, for example, based on which of several operation cycles is chosen in an application such as a clothes drier with which the switch is used.

It is known for suppliers of appliances using fixed temperature thermostats to mount wire heating units externally to the thermostats in heat conductive relation thereto and use these heaters to modify the effective operating temperature of the thermostat to obtain one or more operating temperatures matched to different cycles provided for this appliance. However locating the heating unit externally of the thermostat is relatively inefficient and results in a system which is slow in responsiveness.

U.S. Pat. No. 3,579,167 shows a thermostatic switch having an internal heater assembly placed adjacent to the bimetal disc and used to separately control the actuation of the disc. Such switches are used for example, for providing "brown-out" protection for compressor motors. The heater assembly includes a ceramic disc with a resistive coating on the face of the substrate which is connected to exterior terminals. While this switch is effective for applications in which several watts of energy are required it is not feasible for lower wattage applications in which it is desired to modify the operating temperature of a disc only a few degrees since so little surface area is available on the ceramic disc for such printed heaters.

In motor protector devices which employ a thermostatic disc adapted to carry motor current, it is a common practice to place one or more wire heaters closely adjacent the disc. These heaters are typically in the 10–20 watt range. For example, as shown in U.S. Pat. No. 2,768,342 one heater is connected in series with the starting winding and a second heater is connected in series with the running winding and both are in series with the thermostatic disc. Normal motor current passing through the heaters and the disc will not be sufficient to raise the temperature of the disc to the point where it snaps to its opposite dished configuration to open the electrical contacts. However an overload in one of the windings will cause increased current flow and heat output from its respective heater which will raise the temperature of the disc until it snaps to open the electrical contacts.

In applications involving thermostatic switches in which the bimetal disc is typically only approximately 0.75 inch in diameter and in which it is desired to thermally bias the disc only slightly, for example in the order of 10 to 15 degrees Farenheit, the use of such heater wire is not feasible. That is, at typical applied voltages of 115 the heater wire would be excessively fine in order to provide sufficient high resistance and would occupy too much space for the thermostatic switches involved which have housings in the order of less than an inch in diameter.

In copending application Ser. No. 670,182 filed Nov. 13, 1984, assigned to the assignees of the present invention, a thermostatic switch having multiple temperature operation is disclosed and claimed in which a thermal biasing assembly is disposed in a recess formed in the housing in heat conductive relation with the thermostatic snap acting disc also located in the recess. The thermal biasing assembly comprises a pair of cylindrical film type resistors of a selected rating with a first lead of each resistor welded to a first connector and a second lead of each resistor welded to a second elongated connector. An assembly having the proper wattage rating for a given application is chosen and dropped into place in the thermostat in an annular shaped groove adjacent the disc seat by sliding the connectors into a pair of parallel extending bores formed in the housing and the connectors are then attached to suitable terminals mounted on the thermostat housing. The connectors may be formed of low thermal conductivity material to minimize heat loss from the resistors.

While thermostatic switches made in accordance with the referenced application are effective for many applications it is found that for other applications where greater thermal biasing is desired and even though the connectors may be formed of low thermal conductivity material there is still excessive heat loss from the resistors through the leads, connectors and terminals.

SUMMARY OF THE INVENTION

It is therefor an object of the invention to provide an improved thermostatic switch having multiple temperature operation using cylindrical resistors having maximum thermal biasing of the disc of the thermostatic switch for given resistors. It is another object to provide such a thermostat which is easily assembled and particularly well suited to mass manufacturing techniques. Another object is to provide an inexpensive yet reliable thermostat which can be easily adapted to provide different operating set points. Other objects and features will in part be apparent and in part pointed out hereinafter.

Briefly, a switch made in accordance to the present invention comprises an assembly having a housing forming a switch chamber therein. A cantilevered movable contact arm mounting a movable contact on its free distal end is adapted to move into and out of engagement with a stationary contact. The housing is formed with a recessed portion at an end thereof and a thermostatic snap acting disc is disposed at the recessed portion. A motion transfer pin is slidably mounted in a bore in the housing extending from the center of the disc to the movable contact arm. A heat conductive cap member is placed over the recessed portion to maintain the disc in place and to conduct ambient heat to the disc. The recessed portion includes an annular shaped groove having a bottom wall adjacent the disc seat. A pair of parallel extending bores extend from the bottom wall through the housing. Each bore is enlarged contiguous to the bottom wall of the annular groove and platforms spaced above the bottom wall are formed in the housing adjacent each bore. A pair of cylindrical type resistors of a selected rating with leads prebent so that a distal end portion of each lead extends downwardly are dropped into the annular groove with a distal end portion of one lead of each resistor extending into the enlarged portion of one bore and a distal end portion of a second lead of each resistor extending into the enlarged portion of the second bore. A rivet of electrically conductive material having a relatively poor heat conductivity characteristic is then placed in each bore and forced down with the rivet head physically deforming the resistor leads to make effective electrical connection therewith. The platforms limit the travel of the head and consequently the degree of deformation of the leads. A bottom cover is placed over the switch portion of the housing with the end portion of the rivets extending through apertures provided in the cover and in a pair of terminals. The end portion of the rivet is headed over to lock the resistors and cover in place.

BRIEF DESCRIPTION OF THE DRAWINGS

In the accompanying drawings, in which the preferred embodiment of the inventions is illustrated.

Corresponding reference characters indicate corresponding parts throughout the several views of the drawings.

Figure 1:
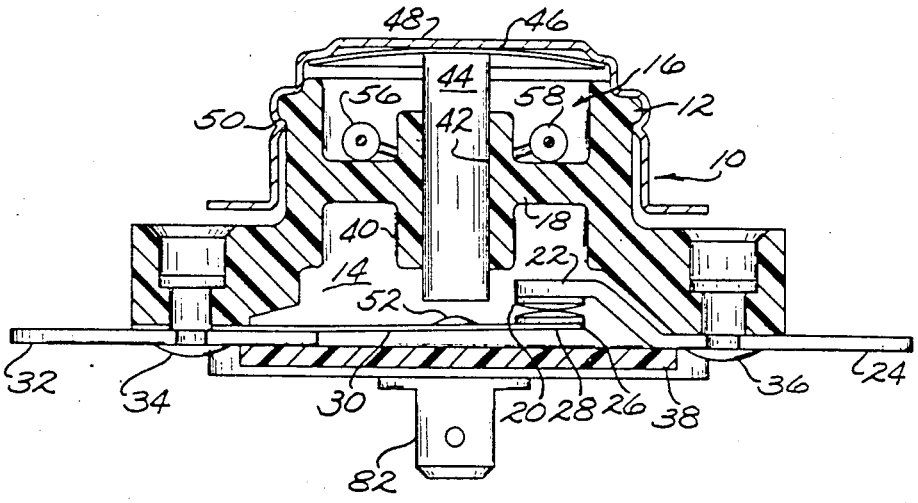
FIG. 1 is a cross sectional elevation view of a thermostatic switch made in accordance with the invention.

Numeral 10 refers generally to a thermostatic switch made in accordance with the invention which comprises a housing 12 of suitable electrically insulative material such as a high temperature phenolic preferably molded to form a switch chamber 14 and a recessed end portion 16 separated by wall 18.

Suitable switch means is disposed in chamber 14 comprising a stationary contact 20 of conventional contact material mounted as by welding on the free distal end 22 of an electrically conductive terminal member 24. Terminal member 24 is bent to extend into the interior of switch chamber 14 to provide space for movement of a movable contact 26. Movable contact 26 is mounted on the distal free end 28 of a flexible, cantilevered, electrically conductive movable contact arm 30. The opposite end of movable contact arm 30 is sandwiched between a terminal 32 and the housing. A rivet 34 is received through suitable apertures in terminal 32 and arm 30 to attach them to housing 12. A similar rivet 36 is used to fix terminal 24 to housing 12. Switch chamber 14 is closed by a plate 38 of electrically insulative material, such as phenolic.

Wall 18 is formed with a centrally located hub 40 formed with a bore 42 extending between switch chamber 14 and recessed end portion 16 and slidably receives therein a motion transfer pin 44.

A thermostatic, snap acting disc 46 is disposed over recessed end portion 16 and is adapted to change from a first dished configuration to a second opposite dished configuration at a first selected actuation temperature and back to the first configuration at a second, lower reset temperature. Disc 46 is maintained in place by a metallic, heat conductive cap 48 which is received over the recessed end of the housing and clamped thereto as indicated at 50. When disc 46 snaps from the downwardly concave configuration shown in FIG. 1 to its opposite downwardly convex configuration (not shown), its motion is transferred to arm 30 through pin 44 which extends from the disc to a protrusion 52 formed on arm 30 to move contact 26 out of engagement with stationary contact 20 and open a circuit extending between terminals 32 and 24.

Figure 2:
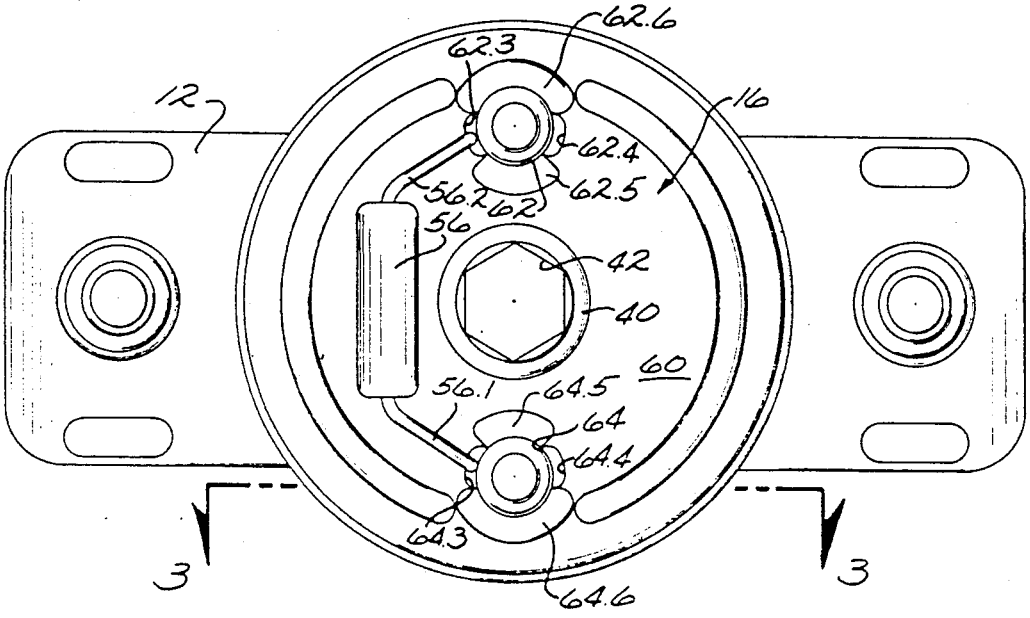
FIG. 2 is a top plan view of the housing used in the FIG. 1 switch, slightly enlarged shown with one of the pair of resistors seated in the annular groove.
Figure 3:
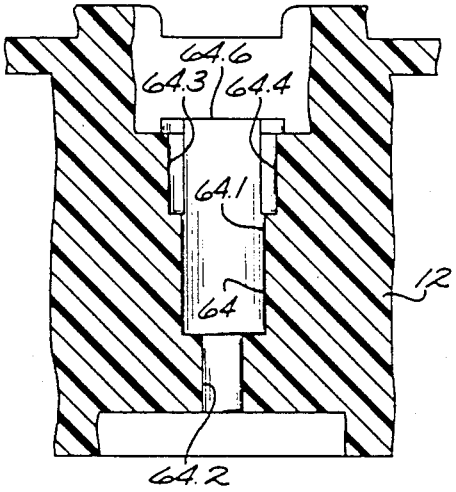
FIG. 3 is a cross sectional view taken on lines 3—3 of FIG. 2.

With particular reference to FIGS. 2 and 3 recess 16 has a bottom wall 60 through which a pair of bores 62, 64 extend to the switch side of housing 12. Bores 62, 64 each have a large diameter portion 62.1, 64.1 respectively, in communication with recess 16 and a small diameter portion 62.2, 64.2 respectively. The large diameter portion of each bore is further enlarged contiguous to bottom wall 60 on two diametrically opposed locations 62.3, 62.4 and 64.3, 64.4 respectively. The enlarged portions are equidistant from the center of the annular groove to accommodate leads from resistors 56, 58 and extend axially along the length of bores 62, 64 respectively a distance sufficient to receive a downwardly bent distal end portion of the resistor leads.

Platforms 62.5, 62.6 and 64.5, 64.6, configured as discontinuous annular portions are formed in housing 12 on opposite sides of respective bores 62, 64 between the enlarged portions of the bores and have a top surface spaced above bottom wall 60 a distance selected to be less than the diameter of the resistor wire. It has been found that a distance in the order of 60% of the diameter of the resistor lead wire is suitable.

Figure 5:
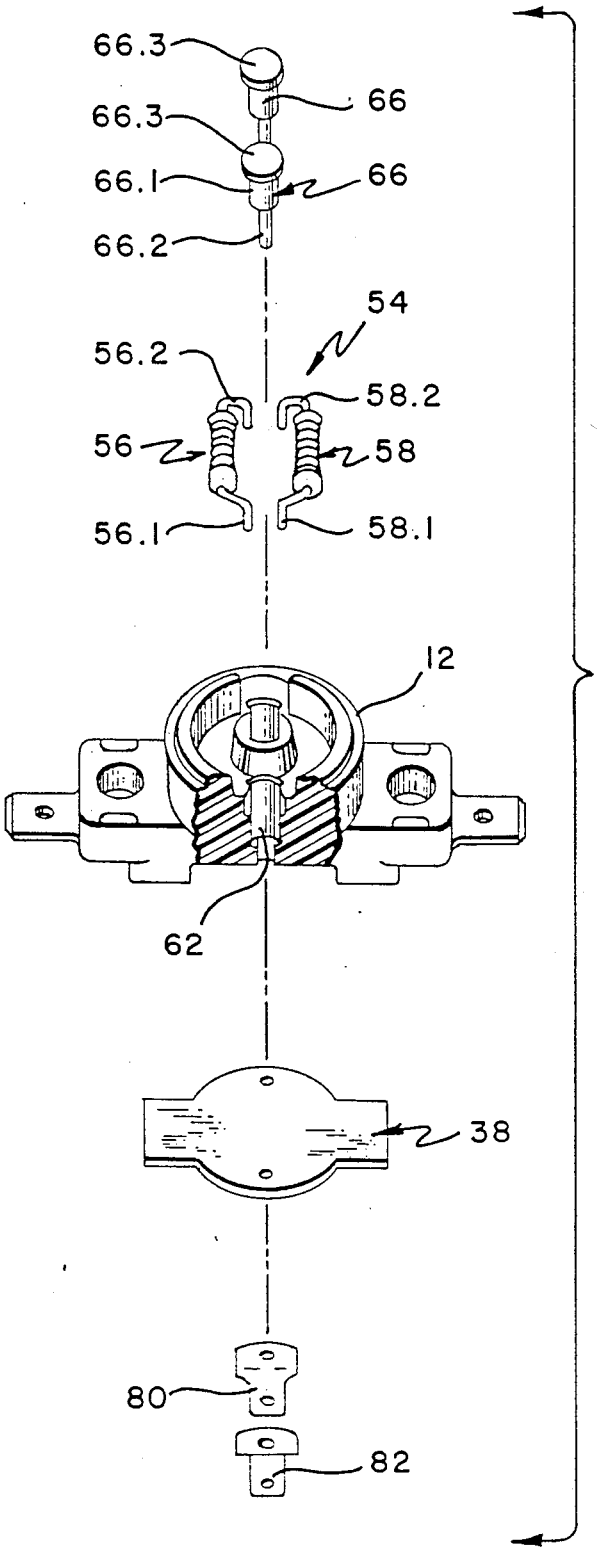
FIG. 5 is a blown apart perspective view of the FIG. 4 apparatus.

Thermal biasing assembly 54 is assembled by taking resistors 56, 58 whose leads 56.1, 56.2, 58.1 and 58.2 have been prebent, as seen in FIG. 5, inwardly with the distal end portions bent downwardly and placing the resistors in recess 16 resting on bottom wall 60 on opposite sides of hub 40 with the distal end portions of the leads received in respective enlarged portions of bores 62, 64. A rivet 66 preferably formed of material having good electrically conductive but relatively poor thermally conductive characteristics such as tin plated steel is then inserted in each bore 62 and 64. Rivet 66 has a large diameter portion 66.1 receivable in bores 62.1 and 64.1 and a small diameter portion 66.2 receivable in bores 62.2 and 64.2. Rivet 66 is formed with a head portion 66.3 having a diameter which is intermediate the inner and the outer diameter of platforms 62.5, 62.6, 64.5, 64.6.

Rivet 66 is forced downwardly until head 66.3 bottoms out on a platform surface. This deforms the leads of the resistors to a thickness equal to the height of the platforms above surface 60, or approximately to 60% of their original diameter. It will be apparent that the particular amount of deformation can be increased or decreased as desired by changing the platform height. As mentioned above, leads of standard resistors are conventionally made of good electrically conductive material, such as tin plated cooper which is relatively soft material and easily deformable. Care must be taken not to excessively deform the leads and possibly sever them. The platforms obviate this possibility. The bottom free end of rivets 66 are received through apertures in cover 38 and respective terminals 80, 82 and headed over, as at 66.4 to lock resistors 56, 58 in place against bottom wall 60 as well as locking in place cover 38 and terminals 80, 82. The rivets are formed with a large diameter portion both to facilitate physical connections with the resistor leads and to provide a rigid structure with no likelihood of buckling when headed over. The small diameter portion decreases heat flow, reduces material content and permits use of a smaller mounting leg for terminals 80, 82.

Locking the resistors against bottom wall 60 not only provides consistent spacing between the resistors and the heat responsive disc from a thermal perspective to thereby provide consistent timing from one device to another, it also insures that a selected minimum electrical isolation distance between the resistors and the metal disc and cap member is maintained in order to comply with standard safety codes.

Figure 4:
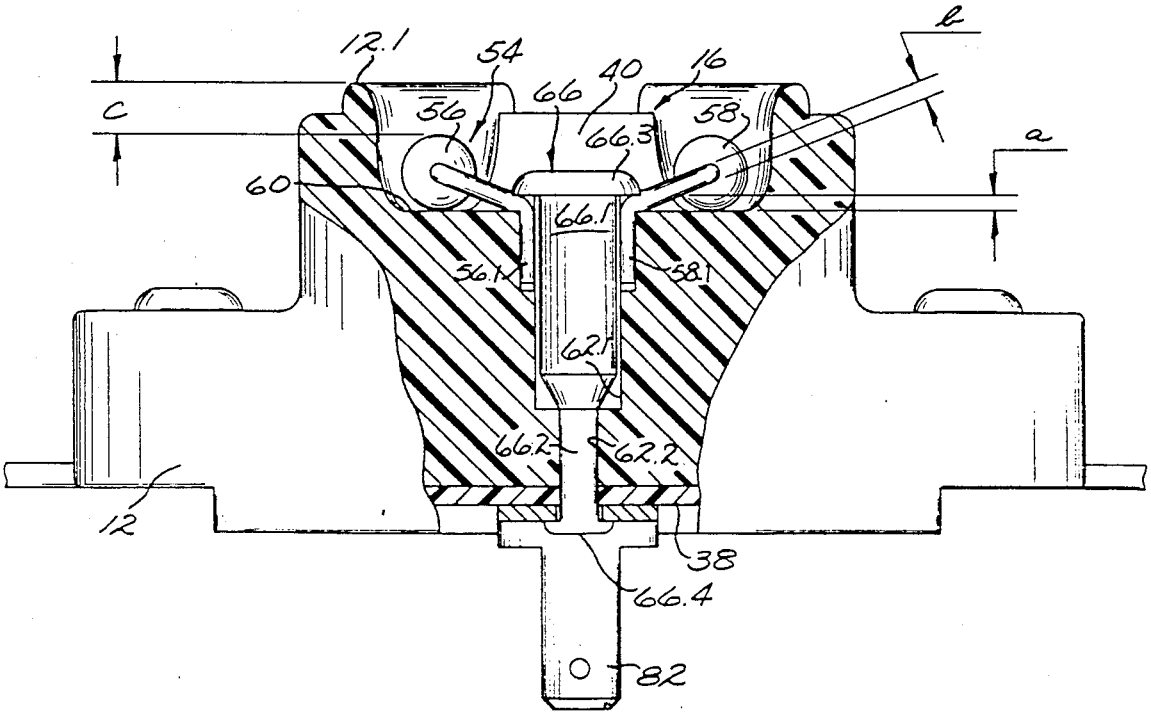
FIG. 4 is an elevation view of the FIG. 1 thermostatic switch with the heat conductive cap and thermostatic disc removed and being partly in cross section to show the mounting arrangement of the cylindrical resistors.

In a switch made in accordance with the invention, as seen in FIG. 4, the leads of the resistors had a diameter "b" of approximately 0.025 inch and the platforms had a top surface spaced a distance "a" of approximately 0.016 inch. This provided a minimum distance "c" of 0.063 inch between the resistors 56, 58 and the surface 12.1 locating snap acting disc 46.

The enlarged portions of bores 62, 64 have a radial width preferably selected to be slightly less than the diameter of the resistor leads to enhance electrical contact with rivet 66. In the switch just described the radial width is approximately 0.02 inch (i.e., 0.02 inch greater than the radius of enlarged diameter bore 62.1, 64.1). The depth of enlarged portions 62.3, 62.4, 64.3, 64.4 is approximately 0.313 inch.

The switch made in accordance with the invention uses a thermostatic disc, approximately 0.75 inch in diameter and 0.010 inch thick formed of B175 material available from Texas Instruments Incorporated. This material is comprised of a layer of nickel-chrome-iron alloy bonded to a layer of nickel-iron. The disc has a dull or heat absorbing surface with an opening temperature of 155° F. and a closing temperature of 140° F. With a thermal biasing assembly comprising two one half watt metal film cylindrical resistors placed approximately a tenth of an inch from the disc its operating temperature was modified to open at 140° F. and close at 125° F. Additional resistance placed in series with the thermal biasing assembly (but located externally to the switch) then allows other operating temperatures within the 15 degree range between the 155° F. unbiased opening temperature and the 140° F. fully biased opening temperature.

Slightly less thermal biasing can be obtained in the above switch by using a disc or the type described except having a shiny heat deflecting surface which results in a bias of one and a half to two degrees less.

Thus the above described invention optimizes thermal biasing of the thermostatic disc from given resistor heaters by minimizing heat loss from the resistors. This is done by eschewing the use of welded connections both between the resistor leads and the rivets and between the rivets and the terminals which provide an electrical path but interpose thermal resistance and by using a relatively poor thermal conductor for the rivet, i.e., a steel rivet. Further, since the resistors are cylindrical, and it will be appreciated that standard resistors actually have a smaller diameter toward their center as opposed to their ends, physical contact with housing 12 which is composed of an electrically insulating material, also a poor thermal conductor, is virtually two points for each resistor thereby providing high thermal resistance.

In view of the above, it will be seen that the several objects of the invention are achieved and other advantageous results obtained. In carrying out the invention either metal layer or carbon layer cylindrical resistors can be employed.

As various changes could be made in the above construction and methods without departing from the scope of the invention, it is intended that all matter included in the above description or shown in the accompanying drawings be interpreted as illustrative not in a limiting sense.

What is claimed is:

1. In a thermostatic electric switch having a housing formed with a switch chamber, stationary and movable contact means disposed in the chamber, the movable contact means adapted to move into and out of engagement with the stationary contact means, terminal means electrically connected to the stationary contact means and the movable contact means to form a circuit, the housing having a recessed end portion, a motion transfer member movably received in an aperture in the housing, the member extending from the movable contact means into the recessed end portion, a thermostatic member disposed at the recessed end portion, the disc movable on the occurrence of selected thermal conditions between a first configuration and a second configuration, the motion of the member being transferred to the movable contact means through the motion transfer member, a metallic cap member received over the recessed end, the improvement comprising a thermal biasing assembly received in the recessed end portion of the housing to modify the effective calibration of the member, the assembly comprising a pair of generally cylindrical resistors, the resistors having first and second leads extending from opposite ends of the resistors, each of the leads having a free distal end bent downwardly, the housing formed with a pair of parallely extending bores communicating with the recessed end portion, one downwardly bent distal end of the leads of each resistor received in one bore and the other downwardly bent distal end of the leads of each resistor received in the other bore, a rivet received in each bore making physical and electrical contact with the resistor leads disposed in the respective bore, and means to lock the rivets and resistors in the housing and provide electrical connection with the rivets whereby the effective calibration of the thermostatic member can be effectively modified by choosing a particular value of resistance for the pair of resistors.

2. A thermostatic electric switch according to claim 1 in which the recessed end portion has a bottom wall and the resistors are seated on the bottom wall.

3. A thermostatic electric switch according to claim 1 in which the recessed end portion has a bottom wall end a stop surface is formed in the housing adjacent each bore a distance above the bottom wall selected as a percentage of the diameter of the resistor leads less than 100% and the rivets have a head with a diameter sufficiently large to engage the stop surface when the rivet is inserted in the bore whereby the resistor leads will be deformed when the rivets are inserted with the heads in engagement with the stop surface.

4. A thermostatic electric switch according to claim 1 in which the bores have enlarged portions contiguous to the recessed end portion adapted to receive the distal ends of the leads.

5. A thermostatic electric switch according to claim 4 in which the radial width of the enlarged portion is selected to be less than the diameter of the resistor leads to provide an interference fit with the rivet.

6. A thermostatic electric switch according to claim 3 in which the bores have enlarged portions contiguous to the recessed end portion adapted to receive the distal ends of the leads.

7. A thermostatic electric switch according to claim 6 in which the radial width of the enlarged portion is selected to be less than the diameter of the resistor leads to provide an interference fit with the rivet.

8. A thermostatic electric switch according to claim 3 in which the stop surface is approximately 0.016 inch above the bottom wall and the diameter of the resistor leads is approximately 0.025 inch.

9. A thermostatic electric switch according to claim 5 in which the diameter of the resistive leads is approximately 0.005 inch greater than the radial width of the enlarged portion.

10. A thermostatic electric switch according to claim 1 in which the rivet is steel.

11. A thermostatic electric switch according to claim 10 in which the rivet has a large diameter portion and a small diameter portion, the large diameter portion alignable with the distal end of the leads.

12. A thermostatic electric switch according to claim 3 in which the stop surfaces comprise two portions of a discontinuous annular platform having an inner and an outer diameter, the inner diameter being essentially the same as the diameter of the bores contiguous to the recessed end portion.

13. A thermostatic electric switch according to claim 12 in which the bores each have two enlarged portions contiguous to the recessed end portion adapted to receive the distal ends of the leads, an enlarged portion being located intermediate the two portions of the discontinuous annular platform at each end thereof.

14. A thermostatic electric switch according to claim 12 in which the rivet has a head with a diameter intermediate the inner and outer diameters of the annular platform.

15. In a thermostatic electric switch having a housing formed with a switch chamber, stationary and movable contact means disposed in the chamber, the movable contact means adapted to move into and out of engagement with the stationary contact means, terminal means electrically connected to the stationary contact means and the movable contact means to form a circuit, the housing having a recessed end portion, a motion transfer member movably received in an aperture in the housing, the member extending from the movable contact means into the recessed end portion, a thermostatic member disposed at the recessed end portion, the member movable on the occurrence of selected thermal conditions between a first configuration and a second configuration, the motion of the member being transferred to the movable contact means through the motion transfer member, a metallic cap member received over the recessed end, the improvement comprising a thermal biasing assembly received in the recessed end portion of the housing to modify the effective calibration of the disc, the assembly comprising a pair of generally cylindrical resistors, the resistors having first and second leads extending from opposite ends of the resistors, each of the leads having a free distal end bent downwardly, the housing formed with a pair of parallely extending bores, one downwardly bent distal end of the leads received in one bore and the other downwardly bent distal end of the leads received in the other bore, a rivet received in each bore making physical and electrical contact with the resistor leads, additional terminal means, the rivets connected to the additional terminal means whereby the effective calibration of the thermostatic member can be effectively modified by choosing a particular value of resistance for the resistors.

16. The method of constructing a thermostatic switch with a thermal biasing assembly having a thermostatic member mounted on a housing at a recessed portion of the housing comprising the steps of providing a pair of parallely extending bores extending from the recessed end of the housing through the housing, selecting a pair of cylindrical resistor elements having a desired wattage rating, the resistor elements having first and second leads extending from opposite ends thereof, placing the resistor elements in the recessed portion of the housing with the first lead of each resistor received in one bore and the second lead of each resistor element received in the other bore, inserting a rivet having a distal end in each bore so that the rivet deforms the resistor leads to make electrical connection therewith and attaching terminal leads to the distal end of the rivets.

17. The method according to claim 16 in which the rivet is formed with a head including the step of forcing the head against the leads through a distance to effect the deformation of the leads as a selected percentage of the diameter of the leads.

* * * * *